US007293504B2

(12) United States Patent
Phelep et al.

(10) Patent No.: US 7,293,504 B2
(45) Date of Patent: Nov. 13, 2007

(54) ELECTRO-PYROTECHNIC INITIATOR

(75) Inventors: Stephane Phelep, Maligny (FR); Philippe Pinet, Venizy (FR)

(73) Assignee: Davey Bickford, Rouen (FR)

( * ) Notice: Subject to any disclaimer, the term of this patent is extended or adjusted under 35 U.S.C. 154(b) by 286 days.

(21) Appl. No.: 10/501,237

(22) PCT Filed: Jan. 10, 2003

(86) PCT No.: PCT/FR03/00080

§ 371 (c)(1),
(2), (4) Date: Jul. 12, 2004

(87) PCT Pub. No.: WO03/058154

PCT Pub. Date: Jul. 17, 2003

(65) Prior Publication Data

US 2005/0081731 A1 Apr. 21, 2005

(30) Foreign Application Priority Data

Jan. 10, 2002 (EP) ..... 02290061

(51) Int. Cl.
*F42B 3/12* (2006.01)
*F42B 3/195* (2006.01)

(52) U.S. Cl. ..... 102/202.7; 102/202.14

(58) Field of Classification Search ..... 102/202.12, 102/202.1, 202.2, 202.5, 202.7, 202.9, 202.11, 102/202.14, 202.3, 202.4, 202.6, 202.8, 322
See application file for complete search history.

(56) References Cited

U.S. PATENT DOCUMENTS

| | | | | |
|---|---|---|---|---|
| 5,423,261 | A | 6/1995 | Bernardy et al. | |
| 5,648,634 | A | 7/1997 | Avory et al. | |
| 5,728,964 | A * | 3/1998 | Avory et al. | 86/1.1 |
| 5,763,814 | A * | 6/1998 | Avory et al. | 102/202.7 |
| 5,932,832 | A * | 8/1999 | Hansen et al. | 102/202.4 |

* cited by examiner

*Primary Examiner*—James S. Bergin
(74) *Attorney, Agent, or Firm*—Young & Thompson

(57) ABSTRACT

An electropyrotechnic initiator includes a pyrotechnic charge (6), the charge (6) containing at least one compound. It also includes a box (1) of plastic material including two sub-assemblies. The first sub-assembly (2) includes a plastic wall (4) integral with a bottom (5) also made of plastic and forming a content. The second plastic sub-assembly (3) having a main axis (10) is traversed by at least two pins (11, 12) along the direction of the axis (10). These pins (11, 12) are connected together by an electric bridge (13) on a face (14) of the sub-assembly (3). This face (14) is hollowed symmetrically over a height H and a width L. The second sub-assembly (3) forms a socket. The first (2) and second (3) sub-assemblies are assembled hermetically by ultrasonic welding.

17 Claims, 4 Drawing Sheets

ELECTRO-PYROTECHNIC INITIATOR

This invention concerns an electropyrotechnic initiator.

There exist two large categories of initiator. The first makes use of sockets of the "glass-metal seal" type and the second to initiators with "plastic" type socket or seal. The initiators belonging to the first category are often considered as being synonymous with guaranteed hermeteicity and infallible protection of pyrotechnic compounds and/or explosives against the effects of extreme environments (humidity among others). Still, it is known that glass-metal seals are sensitive to mechanical and thermal stress which may be applied during the different assembly steps (crimping, welding, . . . ) of said initiators to a civilian pyrotechnic application device (for example, pretensioners, air-bags for automotive safety), or in the military or spatial fields.

Besides, if using a "glass-metal seal" socket guarantees at first view hermetic barrier of the socket along the current input pins, this is not always true of the link between the socket and the pyrotechnic content.

The initiators on plastic seal suffer for their part from a hermeteicity problem associated with the plastic material (for example a polyamide sensitive to humidity) used for their realisation or at their non-tight internal joints (for example clamping, bonding . . . ).

Finally, the current initiators, regardless whether they belong to any of the categories aforementioned, comprise generally several sub-assemblies to be assembled, which increases the cost of such a device. The initiators of the first category are significantly the most expensive due to the necessary preparation (surface treatment, . . . ) of said "glass-metal" seals.

The purpose of this invention is to offer an electropyrotechnic initiator of plastic type, simple in its design and its operating mode, compact and economic, exhibiting excellent hermeteicity properties.

In this view, the invention concerns an electropyrotechnic initiator comprising a box of plastic material and a pyrotechnic charge, said charge containing at least one compound.

According to the invention, the box comprises two sub-assemblies:

- a first sub-assembly containing a plastic wall integral with a bottom, also made of plastic and forming a content,
- a second plastic sub-assembly having a main axis, traversed by at least two pins along the direction of said axis, said pins being linked together by an electric bridge on one face of said sub-assembly, said face being hollowed symmetrically over a height H and a width L, said sub-assembly forming a socket, and
- hermetic assembly of the first and second sub-assemblies is realised by ultrasonic welding.

This invention also regards the characteristics which will appear during the following description and which should be considered individually or in all their technically possible combinations:

- the internal diameter $D_1$ of the first sub-assembly is smaller than the external diameter $D_2$ of the hollowed portion of the second sub-assembly,
- the ultrasonic welding joint is a shear joint,
- the ultrasonic welding joint is a semi-shear joint,
- the hollowed face of the second sub-assembly shows a symmetrical recess with height h and width l to form a raised lump of the electric bridge.
- the plastic used to realise the first and second sub-assemblies is a material with low regain of humidity,

- the plastic is a polyketone,
- the plastic is a teraphthalate polybutylene (PBT),
- the plastic is a polyamide,
- the plastic is the polyamide PA 6.12,
- the pyrotechnic charge is deposited in the first sub-assembly by a dry loading process,
- each compound of the pyrotechnic charge is pre-compressed,
- the primary compound is pre-compressed with a pressure lower than 120 bars and the secondary compound with a pressure greater than 150 bars,
- the vacuum height h' is smaller than the height h+H, H being the height of the welding heel and h the height of the lump,
- the second sub-assembly is moulded over the pins,
- the pins are electrodes,
- the electrodes are scored.

The invention will be described more in detail with reference to the appended drawings wherein.

Figure 1:
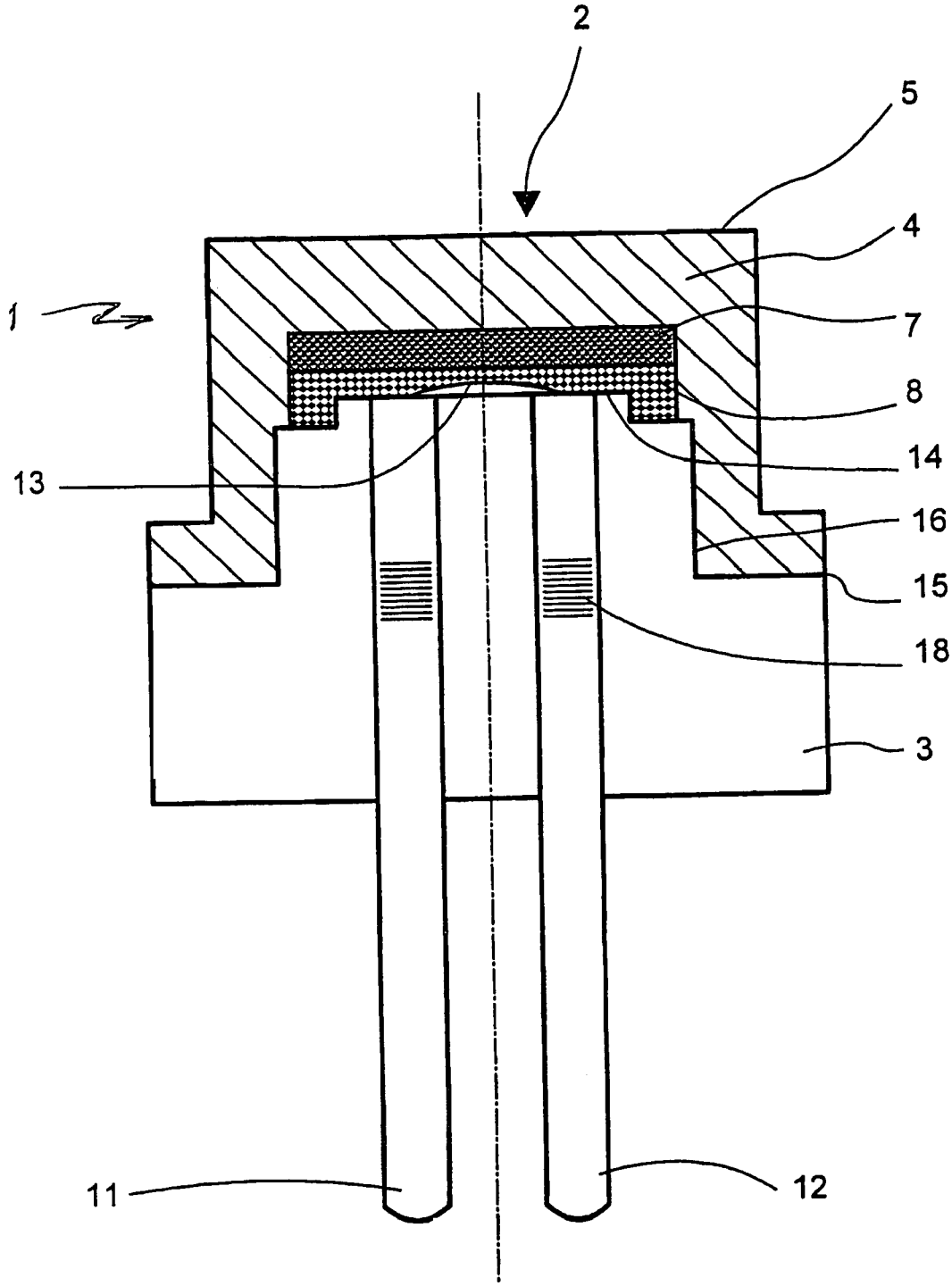
FIG. 1 is a schematic representation of a plastic type initiator, according to the invention.
Figure 2:
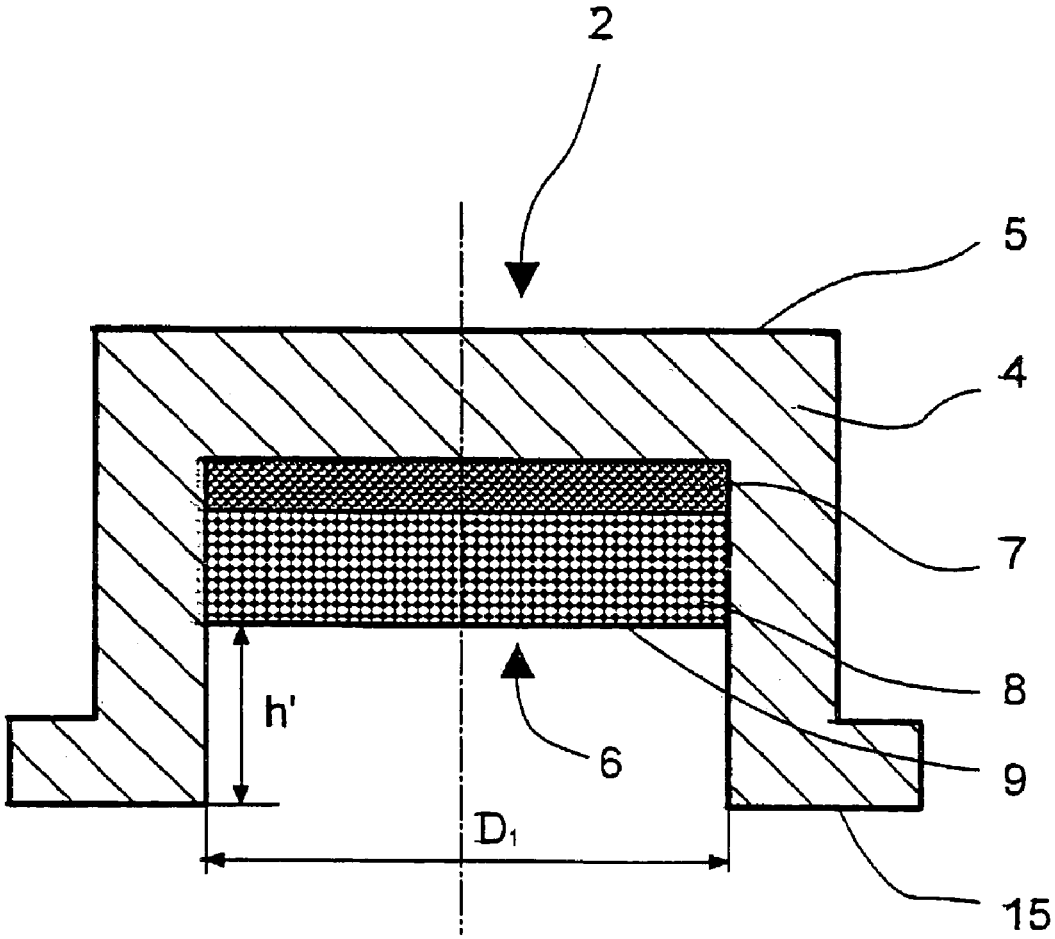
FIG. 2 represents a content, the first sub-assembly of the electropyrotechnic initiator, according to the invention.
Figure 3:
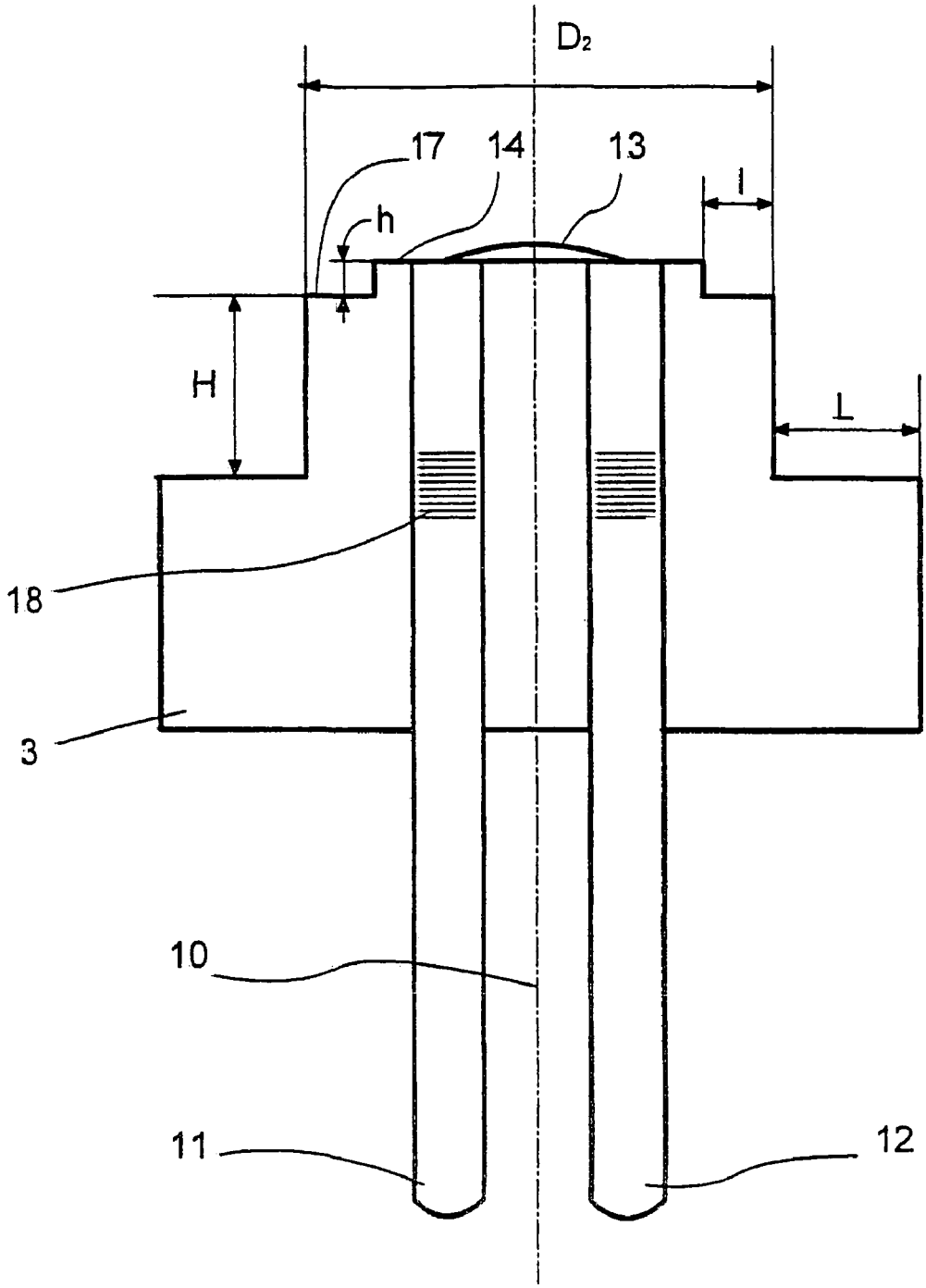
FIG. 3 represents a socket, the second sub-assembly of the electropyrotechnic initiator, according to the invention.

The electropyrotechnic initiator, according to the invention, comprises a box 1. This box 1 comprises a first 2 and second 3 sub-assemblies. The first sub-assembly 2 comprises a plastic wall 4 integral with a bottom 5 also made of plastic, the first sub-assembly 2 being of a single part. This first sub-assembly 2 is called a content. Said content 2 receives a pyrotechnic charge 6 by a dry loading process. The charge 6 comprises at least one compound. In an embodiment, the content 2 receives a first compound 7 called secondary compound and a second compound 8 called primary compound. Each compound of the pyrotechnic charge 6 is loaded in bulk, then pre-compressed. Advantageously, the pre-compression is realised with a pressure smaller than 120 bars for the primary compound 8 and with a pressure greater than 150 bars for the secondary compound 7. The final compression stress is produced when assembling hermetically the first sub-assembly 2 with a second sub-assembly 3 comprising the electric portion of the initiator, said sub-assembly 3 being also called socket. The assembly is made by ultrasonic welding for extreme hermeteicity. Here, by—vacuum height—h' is meant the differential height between the outermost external layer 9 of the pyrotechnic charge 6 after pre-compressing the compounds and the face 15 of the content 2. Advantageously, the first 7 and second 8 compounds are exempt of heavy metals for environment-friendly reasons. Said compounds are also resistant to heating-up caused by ultrasonic welding which is of the order of 260° C.

In a preferred embodiment the internal diameter $D_1$ of the first sub-assembly 2 is smaller than 5.6 mm. The adaptation of the internal volume of the content 2 in order to be able to load pyrotechnic compounds of different natures and particle sizes is therefore ensured by the variation in height of said content 2. The small internal diameter of the first sub-assembly 2 enables advantageously to do away with any intermediate pyrotechnic content such as, for example, a ring added on the socket 3 to limit the pyrotechnic charge 6. This limitation of the pyrotechnic charge 6 offers moreover increased safety without detriment to the reliability of the pyrotechnic operation insofar as the thickness of the compound charged is sufficient.

The second sub-assembly 3, the socket, of plastic has a main axis 10 and is traversed by at least two pins 11, 12 along the direction of said axis 10. The pins 11, 12 are connected together by an electric bridge 13 on a face 14 of said sub-assembly 3. In an embodiment, the electric bridge 13 is of resistive type. Advantageously, it is either a filament or a metal layer. In another embodiment, the electric bridge 13 is of the semiconductor type. Said face 14 is hollowed symmetrically over a height H and a depth L so that the external diameter of the portion of the second sub-assembly 3 having been hollowed, is $D_2$. Advantageously, the height H ranges between 2 and 3 mm. In a preferred embodiment, the internal diameter $D_1$ of the first sub-assembly 2 is smaller than the external diameter $D_2$. These portions of the first 2 and second 3 sub-assemblies being placed opposite one another during ultrasonic welding, this differential diameter between $D_1$ and $D_2$ ensures maximum hermeteicity and sufficient dielectric rigidity for insulation of the internal conducting parts 11, 12 of the initiator. Advantageously, the welding joint 16 is a shear joint. The hollowed face 14 of the second sub-assembly 3 also exhibits a symmetrical recess 17 with height h and width l to form a raised lump of the electric bridge, thereby ensuring good contact between the electric bridge 13 and the primary compound 8. Advantageously h ranges between 0.5 and 1.0 mm and the width 1 ranges between 0.2 and 0.8 mm.

The second sub-assembly 3 is compound-filled on pins 11, 12. Here,—pin—means current supply means for the initiator. In a first embodiment, the pins 11, 12 comprise electrodes. Advantageously, the electrodes are scored. These scores 18 ensure not only hermetic barrier of the initiator along the pins 11, 12 but they also facilitate the fastening of the plastic material during moulding. In a second embodiment, the pins 11, 12 are wires.

The first 2 and second 3 sub-assemblies are realised in the same plastic material in order to enable their assembly by ultrasonic welding. The plastic used to realise the first 2 and second 3 sub-assemblies is a material with low regain of humidity. In a first embodiment, the plastic is a polyketone. In another embodiment, the plastic is a teraphthalate polybutylene (PBT). In a preferred embodiment, the plastic material is a polyamide. As polyamides usable according to the invention, one may suggest polyamides with low regain of humidity, and in particular the polyamide of the following formula:

$$-(NH-(CH_2)_6-NH-CO-(CH_2)_{10}-CO)_n-$$

designated in this application as PA 6.12.

Figure 4:
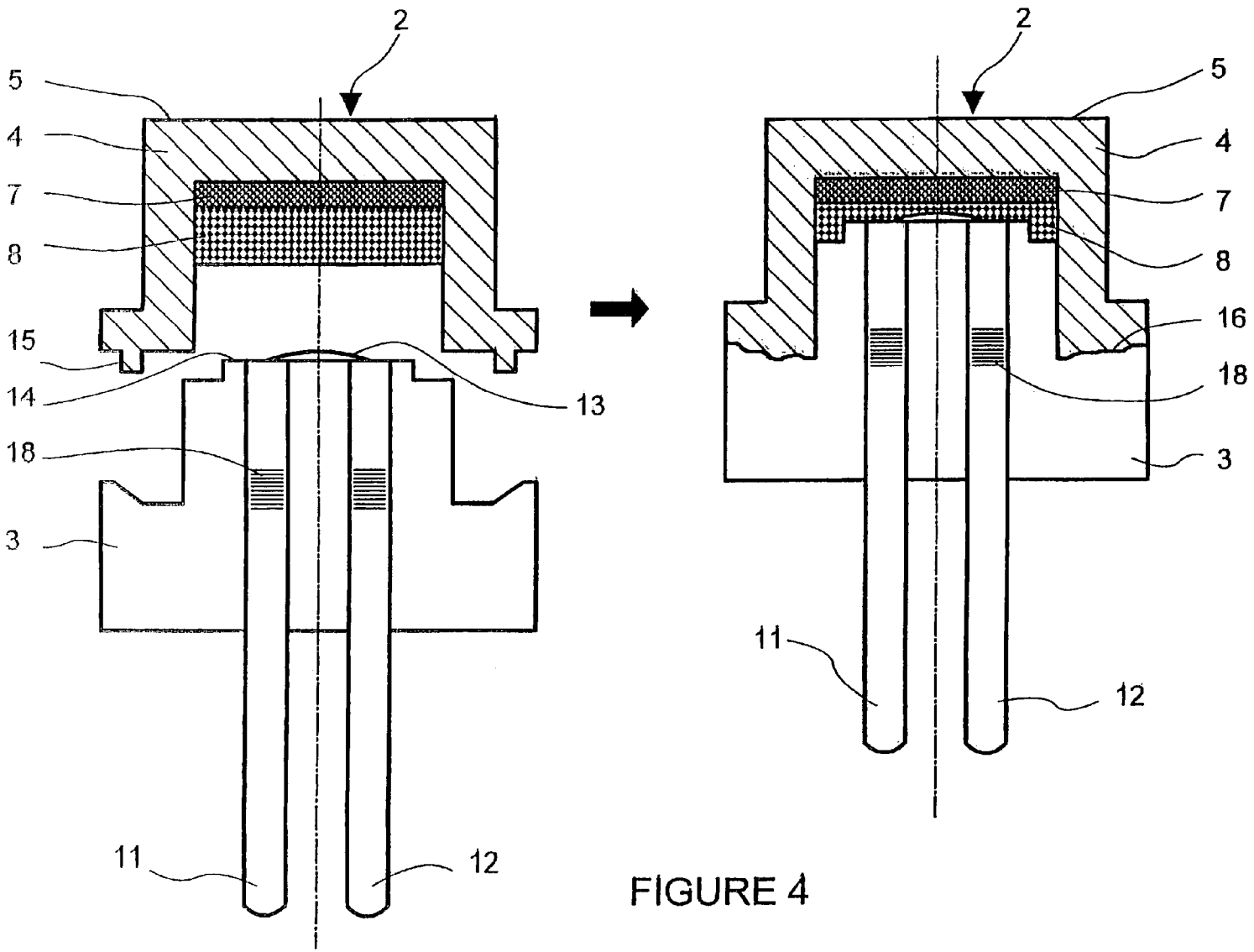
FIG. 4 is a schematic representation of another embodiment of the ultrasonic welding joint, according to the invention.

The sub-assemblies 2, 3 of the initiator according to the invention could not be limited to the preceding description and are subject to modifications with the evolution of technology. Substitutions and/or modifications in the overall structure and in the details of this initiator may be realised by a man of the art without departing from the framework of this invention. Thus, FIG. 4 shows an ultrasonic welding joint 16 which does not comprise a shear joint but a semi-shear joint.

This pyrotechnic initiator may advantageously be used for the realisation of civilian, military and spatial pyrotechnic application devices. In cases where the initiator is in polyketone, it can advantageously be placed in contact with or close to chemical vapours or liquids.

The invention claimed is:

1. An electropyrotechnic initiator comprising a box (1) of plastic material and a pyrotechnic charge (6), said charge (6) comprising at least one compound, characterized in that the box (1) contains two sub-assemblies:

a first sub-assembly (2) made in a single part comprising a plastic wall (4) integral with a bottom (5) also made of plastic, having a face (15) and forming a container, a second plastic sub-assembly (3) made of plastic having a main axis (10), traversed by at least two pins (11, 12) parallel to said axis (10), said pins (11, 12) being connected together by an electric bridge (13) on a face (14) of said second plastic subassembly (3), said face (14) being hollowed symmetrically over a height H and a width L, said sub-assembly (3) forming a base, the second sub-assembly being molded over the pins (11, 12), said first (2) and second (3) sub-assemblies being hermetically assembled by ultrasonic welding, and wherein, before assembly of sub-assemblies, the internal diameter $D_1$ of the first sub-assembly (2) is smaller than the external diameter $D_2$ of the hollowed portion of the second sub-assembly (3) in the portions of the first and second sub-assemblies which are disposed opposite one another during ultrasonic welding.

2. An initiator according to claim 1, characterized in that the hollowed face (14) of the second sub-assembly (3) has a symmetrical recess (17) with height h and width l to form a raised lump of the electric bridge (13).

3. An initiator according to claim 2, characterized in that, before assembly of said sub-assemblies, the vacuum height h' of the first sub-assembly is smaller than the height h+H, of the second sub-assembly, H being the height of the welding heel, h the height of the lump and h' the differential height between the outmost external layer (9) of the pyrotechnic charge (6) after pre-compressing the compounds and said face (15) of the container (2).

4. An initiator according to claim 2, characterized in that the plastic used to make the first and second sub-assemblies is a material with low regain of humidity.

5. An initiator according to claim 1, characterized in that the plastic of the first and second sub-assemblies is a material with low regain of humidity.

6. An initiator according to claim 5, characterized in that the plastic is a polyketone.

7. An initiator according to claim 5, characterized in that the plastic is a teraphthalate polybutylene (PBT).

8. An initiator according to claim 5, characterized in that the plastic is a polyamide.

9. An initiator according to claim 8, characterized in that the plastic is the polyamide PA 6.12.

10. An initiator according to claim 1, characterized in that the second sub-assembly (3) is molded over the pins (11, 12).

11. An initiator according to claim 1, characterized in that the pins (11, 12) comprise electrodes.

12. An initiator according to claim 11, characterized in that the electrodes are scored.

13. An initiator according to claim 1, characterized in that a joint formed by said ultrasonic welding (16) is a shear joint.

14. An initiator according to claim 1, characterized in that a joint formed by said ultrasonic welding is a semi shear joint.

15. A method for assembling the electropyrotechnic initiator of claim 1, characterized in that it comprises:

the production of a first sub-assembly (2) made in a single part comprising a plastic wall (4) integral with a bottom (5) also made of plastic, having a face (15) and forming a container, and of a second sub-assembly (3) made of plastic having a main axis (10), traversed by at least two pins (11, 12) parallel to axis (10), said pins (11, 12) being connected together by an electric bridge (13) on a face (14) of said second plastic sub-assembly (3), said face (14) being hollowed symmetrically over a height H and a width L, said sub-assembly (3) forming a base and being molded over the pins;

providing said first sub-assembly (2) with a pyrotechnic charge (6); and forming a hermetic assembly by ultrasonic welding said first sub-assembly and said second sub-assembly, and in that before assembly of said sub-assemblies, the internal diameter $D_1$ of the first sub-assembly (2) is smaller than the external diameter $D_2$ of the hollowed portion of the second sub-assembly (3) in the portions of the first and second assemblies which are disposed opposite one another during ultrasonic welding.

16. A method for assembling an electronic initiator according to claim 15, characterized in that the pyrotechnic charge comprises a primary compound (8) and a secondary compound (7), and pre-compressing each of said compounds (7, 8) of the pyrotechnic charge.

17. A method for assembling an electrotechnic initiator according to claim 16, characterized in that said pre-compressing is reflected with a pressure less than 120 bars for the primary compound (8) and with a pressure greater than 150 bars for the secondary compound (7).

* * * * *